US006076303A

United States Patent [19]

Orsini

[11] Patent Number: 6,076,303

[45] Date of Patent: Jun. 20, 2000

[54] FILTERING GATE FOR THE PROTECTION OF A SITE, WITH LINEAR PARALLEL MOTION OF THE LEAVES OF THE DOORS

[75] Inventor: Daniele Orsini, Pomezia RM, Italy

[73] Assignee: Progetech S.r.l., Roma, Italy

[21] Appl. No.: 09/230,096

[22] PCT Filed: Jul. 23, 1997

[86] PCT No.: PCT/IT97/00185

§ 371 Date: May 14, 1999

§ 102(e) Date: May 14, 1999

[87] PCT Pub. No.: WO98/03759

PCT Pub. Date: Jan. 29, 1998

[30] Foreign Application Priority Data

Jul. 24, 1996 [IT] Italy ..... RM96A0521

[51] Int. Cl.[7] ..... E06B 7/00

[52] U.S. Cl. ..... 49/68; 109/6

[58] Field of Search ..... 49/68, 31, 95, 49/120, 121; 109/6, 7, 21; 52/207, 64

[56] References Cited

U.S. PATENT DOCUMENTS

| | | | |
|---|---|---|---|
| 1,632,683 | 7/1927 | Tracy | 109/6 |
| 3,967,411 | 7/1976 | Ulmann | 49/68 |
| 4,481,887 | 11/1984 | Urbano | 49/68 |
| 4,656,954 | 4/1987 | Tonali | 109/6 |
| 5,311,166 | 5/1994 | Frye | 109/6 |
| 5,694,867 | 12/1997 | Diaz-Lopez | 49/68 |
| 5,845,692 | 12/1998 | Kellem et al. | 49/68 |

FOREIGN PATENT DOCUMENTS

| | | |
|---|---|---|
| 2 334 809 | 7/1977 | France . |
| 2 672 633 | 8/1992 | France . |
| 1 195 079 | 10/1988 | Italy . |

*Primary Examiner*—Daniel P. Stodola
*Assistant Examiner*—Curtis A. Cohen
*Attorney, Agent, or Firm*—Pillsbury Madison & Sutro LLP

[57] ABSTRACT

A filtering gate for the protection of a site includes two boxes arranged side by side and forming two corridors allowing communication between an inside of the site and an exterior of the site. A first and a second pair of leaves are located at an inside front and an external front, respectively, of the boxes arranged side by side, the leaves of each pair being movable parallel with respect to each other and transverse to a flow passing in the corridors, each leaf being movable independent of the other leaf of the pair, between a first position in which it blocks passage through one of the corridors and a second position in which it blocks passage through the other of the corridors. In a normal operating mode, the movement of one leaf of each pair is immediately followed by the movement of the other leaf of the same pair, as soon as the first leaf of the pair has completed moving between the positions, the movement of each leaf of one of the two pairs of leaves occurring simultaneously with the movement of a corresponding leaf of the other pair of leaves.

6 Claims, 2 Drawing Sheets

FILTERING GATE FOR THE PROTECTION OF A SITE, WITH LINEAR PARALLEL MOTION OF THE LEAVES OF THE DOORS

This application is the national phase of international application PCT/IT97/00185 filed Jul. 23, 1997 which designatede the U.S.

TECHNICAL FIELD

The present invention refers to a filtering gate, designed to protect the access to a site whenever it is desired that the access controlling device does not degrade the transit rate and does not hamper the free circulation of physical disabled persons.

A number of filtering access devices are known, utilised to better save the environmental conditions of air conditioning inside the premises and to realise the electronic checking of the persons who pass through the access, by means of metal detectors.

Double door systems, central pivot revolving door systems for the access to public premises and the so-called "burglar-proof tambours", equipped with metal detectors, for the access to protected premises, typically banks, or to classified premises, are the most used among such devices.

In some of such devices, systems are provided that include separate corridors for a user who enters and for a user who goes out, in which corridors a box is located, closed by two vertically hinged doors, which usually cannot be opened both at the same time.

For example, in the case of banks, the entry box could be provided with metal detectors, suitable to prevent persons, who carry a weapon, from entering the protected site, so that anyone could enter the site only with the consent of such detectors.

More particularly, in such types of safety door systems, vertical cylindrical boxes are provided, in which the access members are in the form of glass walls, having the shape of sectors of a cylinder which, in the phases of opening and closing, are caused to slide along the fixed lateral cylindrical walls of the respective box, these walls being made from safety glass and having the shape of sectors of a cylinder as well.

BACKGROUND ART

In Italian patent N. 1,195,079, a system of boxes has been described, equipped with safety doors, suitable to allow the entry and the exit of one or more persons at the same time, particularly of a physical disabled person in a wheelchair as well. This system can be used in banks, postal agencies, supermarkets or other premises, which must be protected against robberies or the like, or simply from the atmospheric agents.

The central pivot revolving doors are often used in hotels, in the airports and, generally, in all the public premises, where problems of acoustic isolation or the like, exist. The central pivot revolving doors must be manually pushed: they force the user to walk in "short steps", in synchrony with their rotational movement. At last, they do not allow the passage of shopping carts, wheelchairs and bulky objects at all.

Therefore, an attempt, done with the purpose of, so to say, linearizing the rotational path of the central pivot revolving doors, consists of the device, already known, by means of which the leaves of a revolving door are made to travel a rectilinear path included between two 180° rotations, so as to allow physical disabled persons to pass through.

Nevertheless, these kinds of access for disabled, not walking persons show many drawbacks. First of all, they usually show not rectilinear paths of the leaves, thereby involving complex mechanisms, and therefore expensive and onerous to service. This remark is also valid in the case of the device of the Italian patent N. 1,195,079, in which the leaves perform some rectilinear movements at right angles among them, so as to simulate a 360° rotation every four 90° movements.

Therefore, not only the cost, as already stated, but also the poor reliability and the operational slowness are direct consequence of the complexity of the movements and of the mechanisms which carry out them.

DISCLOSURE OF THE INVENTION

Therefore, the main object of the present invention is to provide a filtering gate with two reversible corridors for the entry or exit, in which the leaves of the doors move back and forth in one only direction with a linear motion, without interference between the paths made by the individual leaves.

Another object of the present invention is to provide a filtering gate of the above-cited type, having no architectural barriers, which are obstacles for physical disabled persons.

A further object of the present invention is to provide a filtering gate of simple and inexpensive construction, suitable for mass production.

According to the present invention, a filtering gate for the protection of a site, comprises in combination:

two boxes, having a generically rectangular base, arranged side by side and forming two corridors, placed side by side, which allow the communication between the inside front of said boxes, facing the inside of the site, and the external front of said boxes, facing the outside of the site;

a first pair of leaves, located at said inside front of said boxes arranged side by side, said leaves being mobile parallel the one with respect to the other and crosswise with respect to the flow passing in said corridors, each leaf being mobile in a way mechanically independent from the other leaf of the pair, between a first position in which it blocks the passage in one of said corridors and a second position in which it blocks the passage in the other of said corridors; and a second pair of leaves, located at said external front of said boxes arranged side by side, said leaves being mobile parallel the one with respect to the other and crosswise with respect to the flow passing in said corridors, each leaf being mobile in a way mechanically independent from the other leaf of the pair, between a first position in which it blocks the passage in one of said corridors and a second position in which it blocks the passage in the other of said corridors, the arrangement being such that, in the normal operational conditions, the movement of a leaf of each pair is immediately followed by the movement of the other leaf of the same pair, as soon as the first leaf of the pair has completed its run, the movement of each leaf of one of the two pairs of leaves tacking place at the same time of the movement of the corresponding leaf of the other pair of leaves.

The main advantage achieved with a filtering gate according to the present invention is that such a movement of its four leaves allows a notable increase of the transit flows through the passage, up to at least three hundred entry transits and three hundred exit transits every hour.

A further advantage of the present filtering gate is that it allows the transit, in conditions of total automatism, even of physical disabled persons.

According to an another aspect of the present invention, the four leaves, in a situation of manually piloted emergency, could be moved to lie all at a single side of the gate, obstructing one only of the corridors and leaving the other corridor entirely free, for example for a fast evacuation of the site during a situation of emergency.

Instead, in a situation of intrinsic emergency, for example in case of electric mains breakdown or device failure, the four leaves are moved to a predetermined position, from which they can be opened without operative effort, possibly with suitable keys, in the direction of the outside, by pushing them.

BRIEF DESCRIPTION OF DRAWINGS

The present invention will be further clarified hereinbelow and other advantages will be highlighted by the description of a practical embodiment of the filtering gate for the protection of a site, according to the present invention, this description being given by way of example on a purely illustrative and non-limiting basis, with reference to the accompanying drawings, in which.

BEST MODE FOR CARRYING OUT THE INVENTION

Figure 1:
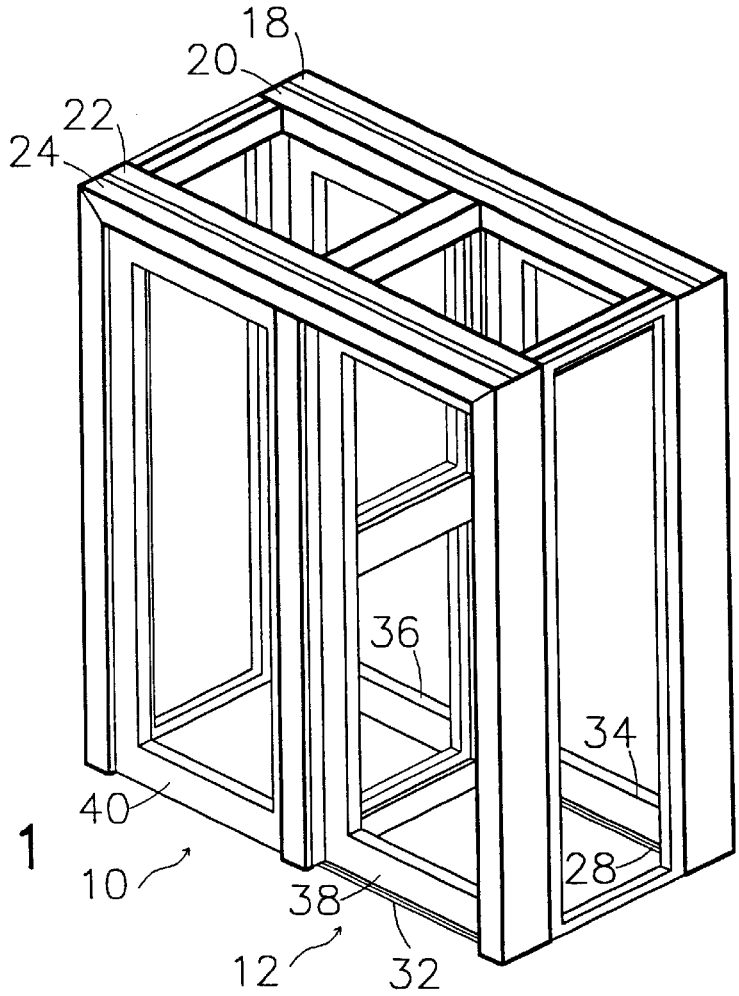
FIG. 1 is a schematic isometric view of a filtering gate according to the present invention.
Figure 2:
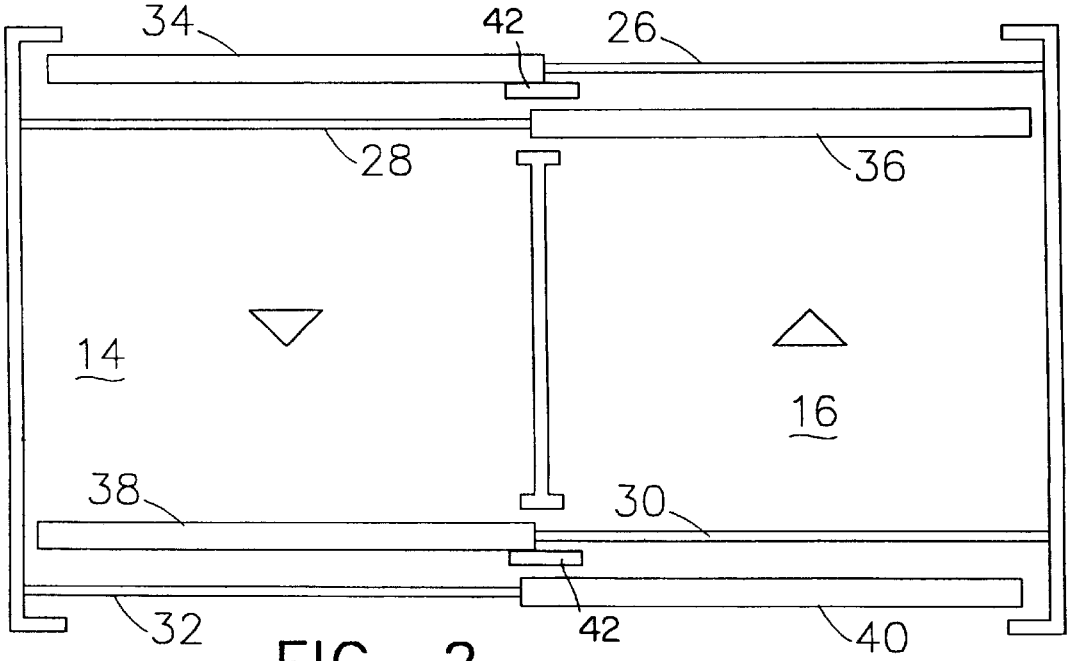
FIG. 2 is a schematic plan view of the gate of FIG. 1.

With reference to the accompanying drawings, and particularly to the FIGS. 1 and 2 thereof, it will be seen that the filtering gate of the present invention comprises in combination two boxes, respectively 10 and 12, having a generically rectangular base, arranged side by side and joined sideways to form a whole. Within each of the two boxes 10 and 12, a corridor is provided, respectively 14 or 16, for the passage indifferentently toward the inside or toward the outside of the site closed by the present gate.

Therefore, each corridor 14 or 16, as well as each box 10 or 12, has one of its fronts faced toward the inside of the protected site and the other of its fronts faced toward the outside of the protected site. The single body, including the two boxes 10 and 12 arranged side by side, is comprised of a structure having an iron tubular frame and includes two pairs of upper stationary slideways 18, 20 and 22, 24, as well as two pairs of stationary ground slideways 26, 28 and 30, 32, for supporting the sliding doors or leaves, one pair for each of its fronts. Each upper slideway 18, 20, 22 or 24 co-operates with the respective ground slideway 26, 28, 30 or 32 to support and guide one of four sliding doors or leaves 34, 36, 38 or 40. Each leaf 34, 36, 38 or 40 is movable, independentently from the other leaves, along two exclusive stationary slideways, between the position in which it closes the end of one of the two corridors 14, 16 and, respectively, the position in which it closes the end of the other of the two corridors 14, 16.

The four leaves 34, 36, 38, 40 are carried out from aluminium profiled bars and carry breaking-proof or musket-proof glasses according to the necessities.

The movement of the leaves is carried out, in a known way, at the upper support slideways 18, 20, 22, 24, formed from aluminium extruded bars, by usual continuous current motors through a likewise usual toothed rubber belt transmission (particulars not shown). Furthermore, coverings are provided, feasible in painted iron, anodised aluminium or stainless steel, according to the needs.

With reference to the FIGS. 3*a*, 3*b*, 3*c* and 3*d*, the operation of the filtering gate according to the present invention, during the normal transit across it, will be now described.

Figure 3A:
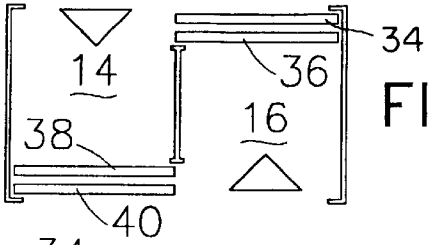
FIGS. 3*a*, 3*b*, 3*c* and 3*d* are schematic plan views showing the gate of FIG. 1 in some different phases of its movement during the normal transit.

With reference to the FIG. 3*a*, it is seen that the normal transit operation begins when a person, schematised with a triangular arrow, engages one of the two corridors 14 or 16 for entering or, respectively, leaving the protected site. Obviously, there could be, at the same time, the entry of a first person through one of the corridors and the exit of an other person through the other corridor, just in this double effectiveness consisting one of the main advantages of the filtering gate according to the present invention.

When a sensor (not shown) reveals, as besides usual, the presence of a person into one of the corridors, a cycle of normal transit begins, under the supervision of an electronic microprocessor controller (not shown), of usual type, which receives impulses from sensors, of usual type, (not shown) and sends impulses to actuating motors of usual type (not shown).

Figure 3B:
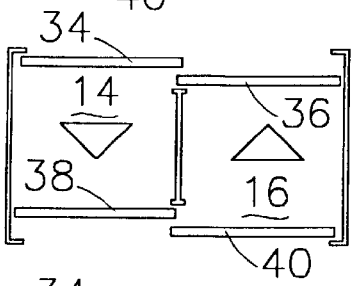
Figure 3C:
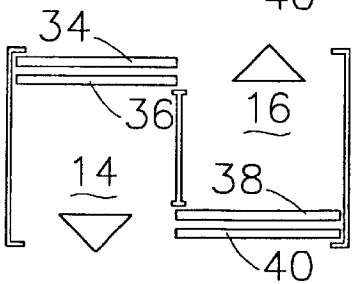
Figure 3D:
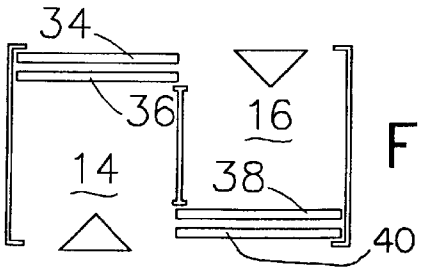

As it is well seen from the FIG. 3*b*, the contemporaneous movement of the two leaves 34 and 40, which are the most distant from the centre of the respective box, happens at first and, immediately after, as shown in the FIG. 3*c*, also the contemporaneous movement of the two others leaves 36 and 38, which are the nearest to the centre of the respective box, happens.

Therefore, there is not any time in which any of the two corridors 14 or 16 is totally open. Immediately after the movement of the inner leaves 36 and 38, the present filtering gate is immediately ready for the next transit. This time, the transit has a flow reversed with respect to the preceding time, as better shown in FIG. 3*d*, as opposed to FIG. 3*a*.

Obviously, the present filtering gate could be used by combining it, according to techniques well known to the skilled of the art, with other products, such as metal detectors, badge readers or cameras, and could be used for specific uses in the field of the access control, of the burglar-proof safety and the like.

According to the conditions of use, such as more or less great flows, alert from a metal detector, emergencies, the electronic controller optimises the motions of the four leaves 34, 36, 38 and 40.

Figure 4:
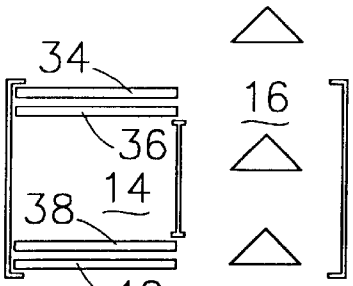
FIG. 4 is a schematic plan view showing the gate of FIG. 1 in the phase of manually piloted emergency.

In the case of piloted emergency, as better shown in FIG. 4, all the four leaves 34, 36, 38 and 40 are moved toward a same side of the gate, by means of a suitable command sent to the electronic controller. In this way, one of the corridors, in the present case the corridor 16, is kept completely free, for example to allow the rapid evacuation from the site.

Figure 5A:
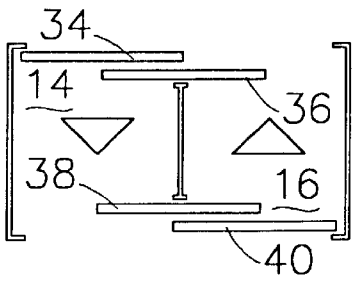
FIGS. 5*a*, 5*b* and 5*c* are schematic plan views showing the gate of FIG. 1 in various phases of its movement during an intrinsic emergency.
Figure 5B:
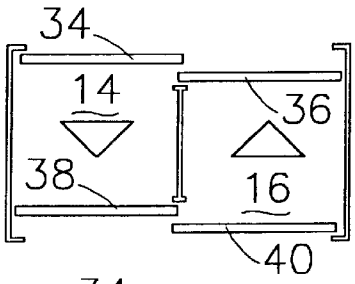

In case of electric mains breakdown or device failure during the transits, as better schematised in FIG. 5*a*, the four leaves 34, 36, 38 and 40 are moved to the position shown in FIG. 5*b*, for example by the action of the weight of some heavy masses acting by gravity on the mechanisms moving the leaves themselves.

By moving the leaves to the position shown in FIG. 5*b*, the isolation of the site protected by the present filtering gate is assured.

Figure 5C:
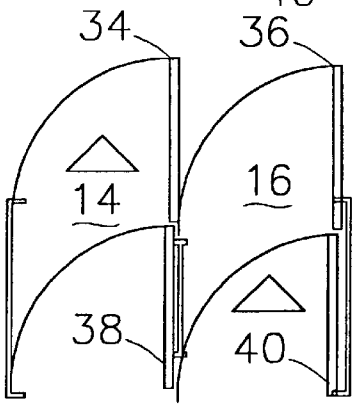

In case of emergency, the four leaves 34, 36, 38 and 40 could be opened toward the outside, as better shown in FIG. 5*c*, by manually acting on suitable unlocking devices, operated, for example, by means of safety keys.

Therefore, it can be easily noticed that the filtering gate of the present invention allows the emergency evacuation in any condition of use.

In a variation of the embodiment, the leaves 34, 36, 38 and 40 are guided by two upright stabiliser plates 42, located at the central post placed between the two boxes 10 and 12. In this case, the ground slideways 26, 28, 30 and 32 are no longer necessary.

Although only one preferred embodiment of the filtering gate for the protection of a site has been specifically illustrated and described herein, it is to be understood that other minor variations may be made in the construction thereof without departing from the spirit and scope of the invention as defined by the appended claims.

What is claimed is:

1. A filtering gate for the protection of a site, comprising:

two boxes, having a generally rectangular base, arranged side by side and forming two corridors, placed side by side, which allow communication between an inside front of said boxes, for facing an inside of the site, and an external front of said boxes, for facing an exterior of the site;

a first pair of leaves, located at said inside front of said boxes arranged side by side, said leaves being movable parallel with respect to each other and transverse to a flow passing in said corridors, each leaf being movable independent of the other leaf of the pair, between a first position in which it blocks passage through one of said corridors and a second position in which it blocks passage through the other of said corridors; and a second pair of leaves, located at said external front of said boxes arranged side by side, said leaves being movable parallel with respect to each other and transverse to the flow passing in said corridors, each leaf being movable independent of the other leaf of the pair, between a first position in which it blocks the passage through one of said corridors and a second position in which it blocks the passage through the other of said corridors, wherein, in a normal operating mode, the movement of one leaf of each pair is immediately followed by the movement of the other leaf of the same pair, as soon as the first leaf of the pair has completed moving between said positions, the movement of each leaf of one of the two pairs of leaves occurring simultaneously with the movement of a corresponding leaf of the other pair of leaves.

2. A filtering gate according to claim 1, wherein each of said four leaves is supported and guided by a corresponding upper stationary slideway.

3. A filtering gate according to claim 2, wherein each of said four leaves is further guided by a corresponding ground slideway.

4. A filtering gate according to claim 2, wherein each of said four leaves is further guided by an upright stabiliser plate.

5. A filtering gate according to claim 1, wherein, in a manually piloted emergency operating mode, all said four leaves are movable to a single side of said gate, obstructing only one of the corridors and leaving the other of the two corridors open.

6. A filtering gate according to claim 1, wherein, in an intrinsic emergency operating mode, said four leaves are movable to at least one of a position whereby each of said corridors is obstructed by one of the first pair of leaves and one of the second pair of leaves and a position whereby each of the four leaves is rotated along one side thereof to open both corridors.

* * * * *